United States Patent [19]

Banerjee et al.

[11] Patent Number: 5,042,509

[45] Date of Patent: Aug. 27, 1991

[54] METHOD FOR MAKING AEROSOL GENERATING CARTRIDGE

[75] Inventors: Chandra K. Banerjee, Pfafftown; Ernest G. Farrier, Winston-Salem; Henry T. Ridings, Lewisville; Andrew J. Sensabaugh, Jr., Winston-Salem; Michael D. Shannon, Lewisville; Gary R. Shelar, Greensboro, all of N.C.; Jack F. Clearman, Blakely, Ga.; Thomas L. Gentry, Winston-Salem, N.C.

[73] Assignee: R. J. Reynolds Tobacco Company, Winston-Salem, N.C.

[21] Appl. No.: 88,619

[22] Filed: Aug. 21, 1987

Related U.S. Application Data

[63] Continuation of Ser. No. 790,484, Oct. 23, 1985, Pat. No. 4,714,082, which is a continuation-in-part of Ser. No. 650,604, Sep. 14, 1984, Pat. No. 4,793,365, and a continuation-in-part of Ser. No. 684,537, Dec. 21, 1984, abandoned, and a continuation-in-part of Ser. No. 769,532, Aug. 26, 1985.

[51] Int. Cl.[5] ..... A24D 5/00

[52] U.S. Cl. ..... 131/71; 131/280; 131/70; 131/76; 131/77

[58] Field of Search ..... 131/351, 336, 194, 195, 131/180, 70, 76, 71, 77, 280

[56] References Cited

U.S. PATENT DOCUMENTS

| | | |
|---|---|---|
| Re. 27,214 | 11/1971 | Nakahara . |
| 29,436 | 7/1860 | Lindsley . |
| 235,886 | 12/1880 | Lindsley . |
| 261,056 | 7/1882 | Smith . |
| 1,770,616 | 7/1930 | Kean . |
| 1,879,128 | 9/1932 | Desper . |
| 2,098,619 | 11/1937 | Finnell . |
| 2,178,820 | 11/1939 | Todoroff . |
| 2,220,418 | 11/1965 | Cohn . |
| 2,471,116 | 5/1949 | Newberger . |
| 2,890,704 | 6/1959 | Lamm . |
| 2,907,686 | 10/1959 | Siegel . |
| 2,998,012 | 8/1961 | Lamm . |
| 3,080,870 | 3/1963 | Allen ..... 131/351 |
| 3,098,492 | 7/1963 | Wurzburg et al. . |
| 3,223,090 | 12/1965 | Struble . |
| 3,258,015 | 6/1966 | Ellis et al. . |
| 3,356,094 | 12/1967 | Ellis et al. . |
| 3,516,417 | 6/1970 | Moses . |
| 3,540,456 | 11/1970 | McGlumphy . |
| 3,550,598 | 12/1970 | McGlumphy . |
| 3,614,956 | 10/1971 | Thornton . |
| 3,713,451 | 1/1973 | Bromberg . |
| 3,738,374 | 6/1973 | Bennett . |
| 3,863,644 | 2/1975 | Hunt . |
| 3,885,574 | 5/1975 | Borthwick et al. . |
| 3,931,824 | 1/1976 | Miano et al. . |
| 3,943,941 | 3/1976 | Boyd et al. . |
| 4,008,723 | 2/1977 | Borthwick et al. . |
| 4,027,679 | 6/1977 | Kaswan . |

(List continued on next page.)

FOREIGN PATENT DOCUMENTS

| | | |
|---|---|---|
| 276250 | 7/1965 | Australia . |
| 687136 | 5/1964 | Canada . |
| 117355 | 12/1983 | European Pat. Off. . |
| 015662 | 10/1985 | European Pat. Off. . |
| 13985/3890 | 9/1985 | Liberia . |
| 275420 | 5/1961 | Switzerland . |
| 956544 | 4/1964 | United Kingdom . |
| 1185887 | 3/1970 | United Kingdom . |
| 1431045 | 4/1972 | United Kingdom . |

OTHER PUBLICATIONS

Hackh's Chemical Dictionary, 34 (4th Ed., 1969).
Langes Handbook of Chemistry, 10, 272–274 (11th Ed., 1973).

(List continued on next page.)

*Primary Examiner*—V. Millin
*Attorney, Agent, or Firm*—Grover M. Myers; David G. Conlin

[57] ABSTRACT

Making an aerosol generating cartridge useful for a smoking article is described. The method comprises filling a non-combustible elongated capsule, open at one end, with a substrate bearing an aersol forming material, and applying a fuel element to the open end of the capsule to enclose the substrate within the capsule.

13 Claims, 4 Drawing Sheets

U.S. PATENT DOCUMENTS 4,044,777 8/1977 Boyd et al. .
4,079,742 3/1978 Ranier et al. .
4,219,031 8/1980 Ranier .
4,219,032 8/1980 Tabatznik .
4,284,089 8/1981 Ray .
4,286,604 9/1981 Ehretsmann et al. .
4,289,149 9/1981 Kyriakou .
4,326,544 4/1982 Hardwick et al. .
4,340,072 7/1982 Bolt et al. .
4,347,855 9/1982 Lanzilotti et al. .
4,391,285 7/1983 Burnett et al. .
4,474,191 10/1984 Steiner .
4,480,650 11/1984 Weinert .
4,481,958 11/1984 Ranier et al. .
4,510,750 4/1985 Keritsis et al. .
4,553,556 11/1985 Lephardt .
4,570,650 2/1986 Sirota .
4,596,258 6/1986 Steiner .

OTHER PUBLICATIONS

Ames et al., Mut. Res. 31:347–364 (1975).
Nago et al., Mut. Res., 42:335 (1977).
Sitting, Tobacco Substitutes, Noyes Data Corporation (1976).
Guiness Book of World Records, 1985 Edition, pp. 242–243.
Guiness Book of World Records, 1966 Edition, p. 194.

METHOD FOR MAKING AEROSOL GENERATING CARTRIDGE

This is a continuation of copending U.S. application Ser. No. 790,484, filed 23 Oct. 1985, now U.S. Pat. No. 4,714,082 which in turn, is a continuation-in-part of application Ser. No. 650,604, filed Sept. 14, 1984 now U.S. Pat. No. 4,793,365, application Ser. No. 684,537, filed Dec. 21, 1984, now abandoned and application Ser. No. 769,532, filed Aug. 26, 1985, which applications are incorporated herein by reference.

BACKGROUND OF THE INVENTION

The present invention relates to a smoking article, preferably in cigarette form, which produces an aerosol that resembles tobacco smoke, and which advantageously contains substantially reduced amounts of incomplete combustion and pyrolysis products than are normally produced by a conventional cigarette.

Many smoking articles have been proposed through the years, especially over the last 20 to 30 years, but none of these products has ever realized any commerical success.

Tobacco substitutes have been made from a wide variety of treated and untreated plant material, such as cornstalks, eucalyptus leaves, lettuce leaves, corn leaves, cornsilk, alfalfa, and the like. Numerous patents teach proposed tobacco substitutes made by modifying cellulosic materials, such as by oxidation, by heat treatment, or by the addition of materials to modify the properties of cellulose. One of the most complete lists of these substitutes is found in U.S. Pat. No. 4,079,742 to Rainer et al. Despite these extensive efforts, it is believed that none of these products has been found to be satisfactory as a tobacco substitute.

Many smoking articles have been based on the generation of an aerosol or a vapor. Some of these products purportedly produce an aerosol or a vapor without heat. See, e.g., U.S. Pat. No. 4,284,089 to Ray. However, the aerosols or vapors from these articles fail to adequately simulate tobacco smoke.

Some proposed aerosol generating smoking articles have used a heat or fuel source in order to produce an aerosol. However, none of these articles has ever achieved any commericial success, and it is believed that none has ever been widely marketed. The absence of such smoking articles from the marketplace is believed to be due to a variety of reasons, including insufficient aerosol generation, both initially and over the life of the product, poor taste, off-taste due to the thermal degradation of the smoke former and/or flavor agents, the presence of substantial pyrolysis products and sidestream smoke, and unsightly appearance.

One of the earliest of these proposed articles was described by Siegel in U.S. Pat. No. 2,907,686. Siegel proposed a cigarette substitute which included an absorbent carbon fuel, preferably a 2 ½ inch (63.5 mm) stick of charcoal, which was burnable to produce hot gases, and a flavoring agent carried by the fuel, which was adapted to be distilled off incident to the production of the hot gases. Siegel also proposed that a separate carrier could be used for the flavoring agent, such as a clay, and that a smoke-forming agent, such as glycerol, could be admixed with the flavoring agent. Siegel's proposed cigarette substitute would be coated with a concentrated sugar solution to provide an impervious coat and to force the hot gases and flavoring agents to flow toward the mouth of the user. It is believed that the presence of the flavoring and/or smoke-forming agents in the fuel of Siegel's article would cause substantial thermal degradation of those agents and an attendant off-taste. Moreover, it is believed that the article would tend to produce substantial sidestream smoke containing the aforementioned unpleasant thermal degradation products.

Another such article was described by Ellis et al. in U.S. Pat. No. 3,258,015. Ellis et al. proposed a smoking article which had an outer cylinder of fuel having good smoldering characteristics, preferably fine cut tobacco or reconstituted tobacco, surrounding a metal tube containing tobacco, reconstituted tobacco, or other source of nicotine and water vapor. On smoking, the burning fuel heated the nicotine source material to cause the release of nicotine vapor and potentially aerosol generating material, including water vapor. This was mixed with heated air which entered the open end of the tube. A substantial disadvantage of this article was the ultimate protrusion of the metal tube as the tobacco fuel was consumed. Other apparent disadvantages of this proposed smoking article include the presence of substantial tobacco pyrolysis products, the substantial tobacco sidestream smoke and ash, and the possible pyrolysis of the nicotine source material in the metal tube.

In U.S. Pat. No. 3,356,094, Ellis et al. modified their original design to eliminate the protruding metal tube. This new design employed a tube made out of a material, such as certain inorganic salts or an epoxy bonded ceramic, which became frangible upon heating. This frangible tube was them removed when the smoker eliminated ash from the end of the article. Even though the appearance of the article was very similar to a conventional cigarette, apparently no commerical product was ever marketed.

In U.S. Pat. No. 3,738,374, Bennett proposed the use of carbon or graphite fibers, mat, or cloth associated with an oxidizing agent as a substitute cigarette filler. Flavor was provided by the incorporation of a flavor or fragrance into the mouthend of an optional filter tip.

U.S. Pat. Nos. 3,943,941 and 4,044,777 to Boyd et al. and British Patent No. 1,431,045 proposed the use of a fibrous carbon fuel which was mixed or impregnated with volatile solids or liquids which were capable of distilling or subliming into the smoke stream to provide "smoke" to be inhaled upon burning of the fuel. Among the enumerated smoke producing agents were polyhydric alcohols, such as propylene gylcol, gylcerol, and 1,3-butylene glycol, and glyceryl esters, such as triacetin. Despite Boyd et al.'s desire that the volatile materials distill without chemical change, it is believed that the mixture of these materials with the fuel would lead to substantial thermal decomposition of the volatile materials and to bitter off tastes. Similar products were proposed in U.S. Pat. No. 4,286,604 to Ehretsmann et al. and in U.S. Pat. No. 4,326,544 to Hardwick et al.

Bolt et al., in U.S. Pat. No. 4,340,072, proposed a smoking article having a fuel rod with a central air passageway and a mouthend chamber containing an aerosol forming agent. The fuel rod preferably was a molding or extrusion of reconstituted tobacco and/or tobacco substitute, although the patent also proposed the use of tobacco, a mixture of tobacco substitute material and carbon, or a sodium carboxymethylcellulose (SCMC) and carbon mixture. The aerosol forming agent was proposed to be a nicotine source material, or granules or microcapsules of a flavorant in triacetin or benzyl benzoate. Upon burning, air entered the air passage where it was mixed with combustion gases from the burning rod. The flow of these hot gases reportedly ruptured the granules or microcapsules to release the volatile material. This material reportedly formed an aerosol and/or was transferred into the mainstream aerosol. It is believed that the articles of Bolt et al., due in part to the long fuel rod, would produce insufficient aerosol from the aerosol former to be acceptable, especially in the early puffs. The use of microcapsules or granules would further impair aerosol delivery because of the heat needed to rupture the wall material. Moreover, total aerosol delivery would appear dependent on the use of a large mass of tobacco or tobacco substitute materials, which would provide substantial pyrolysis products and sidestream smoke which would not be desirable in this type smoking article.

U.S. Pat. No. 3,516,417 to Moses proposed a smoking article, with a tobacco fuel, which was identical to the article of Bolt et al., except that Moses used a double density plug of tobacco in lieu of the granular or microencapsulated flavorant of Bolt et al. See FIG. 4, and col. 4, lines 17–35. Similar tobacco-based fuel articles are described in U.S. Pat. No. 4,347,855 to Lanzilotti et al. and in U.S. Pat. No. 4,391,285 to Burnett et al. European Patent Application Publication Number 117,355, Hearn et al., describes similar smoking articles having a pyrolyzed ligno-cellulosic heat source with an axial passageway therein. These articles would suffer many of the same problems as the articles proposed by Bolt et al.

Steiner, in U.S. Pat. No. 4,474,191, describes "smoke devices" containing an air-intake channel which, except during the lighting of the device, is completely isolated from the combustion chamber by a fire resistant wall. To assist in the lighting of the device, Steiner provides means for allowing the brief, temporary passage of air between the combustion chamber and the air-intake channel. Steiner's heat conductive wall also serves as a deposition area for nicotine and other volatile or sublimable tobacco simulating substances. In one embodiment (FIGS. 9 and 10), the device is provided with a hard, heat transmitting envelope. Materials reported to be useful for this envelope include ceramics, graphite, metals, etc. In another embodiment, Steiner envisions the replacement of his tobacco (or other combustible material) fuel source with some purified cellulose-based product in an open cell configuration, mixed with activated charcoal. This material, when impregnated with an aromatic substance, is stated to dispense a smoke-free, tobacco-like aroma.

Despite decades of interest and effort, there is still no smoking article on the market which provides the benefits and advantages associated with conventional cigarette smoking, without delivering the considerable quantities of incomplete combustion and pyrolysis products generated by a conventional cigarette.

SUMMARY OF THE INVENTION

The invention comprises a smoking article, preferably in cigarette form, which utilizes a small, high density combustible fuel element in conjunction with a physically separate aerosol generating means which includes one or more aerosol forming materials. Preferably, the aerosol generating means is in a conductive heat exchange relationship with the fuel element and/or at least a portion of the fuel element is circumscribed by a resilient insulating jacket to reduce radial heat loss. Upon lighting, the fuel element generates heat which is used to volatilize the aerosol forming materials in the aerosol generating means. These volatile materials are then drawn toward the mouth end, especially during puffing, and into the user's mouth, akin to the smoke of a conventional cigarette.

The invention further comprises a method of making an aerosol generating cartridge for a smoking article. The method comprises providing a non-combustible elongated capsule open at one end, filling the capsule with aerosol forming materials, and applying a fuel element to the open end of the capsule to enclose the aerosol forming material within the capsule. Preferably, the fuel element portion is circumscribed with an insulating material.

Smoking articles of the invention are capable of producing substantial quantities of aerosol, both initially and over the useful life of the product, and are capable of providing the user with the sensations and benefits of cigarette smoking. The aerosol produced by the aerosol generating means is produced without significant thermal degradation and is advantageously delivered to the user with substantially reduced amounts of pyrolysis and incomplete combustion products than are normally delivered by a conventional cigarette.

The small fuel element utilized in the invention is less than about 30 mm in length, preferably less than about 20 mm in length, and has a density of at least about 0.5 g/cc, more preferably of at least about 0.7 g/cc, as measured, e.g., by mercury displacement. Suitable fuel elements may be molded or extruded from comminuted or reconstituted tobacco and/or a tobacco substitute, and preferably contain combustible carbon. Preferred fuel elements also are provided with one or more longitudinal passageways, more preferably from 5 to 9 passageways or more, which help to control the transfer of heat from the burning fuel element to the aerosol forming materials in the aerosol generating means.

Advantageously, the aerosol generating means includes a substrate or carrier, preferably of a heat stable material; bearing one or more aerosol forming materials. Preferably, the conductive heat exchange relationship between the fuel and the areosol generator is achieved by providing a heat conducting member, such as a metal conductor, which contacts the fuel element and the aerosol generating means and efficiently conducts or transfers heat from the burning fuel element to the aerosol generating means. This heat conducting member preferably contacts the fuel element and the aerosol generating means around at least a portion of their peripheral surfaces and preferably is recessed or spaced from the lighting end of the fuel element, advantageously by at least about 3 mm, preferably by at least about 5 mm, to avoid interference with lighting and burning of the fuel and to avoid any protrusion of the heat conducting member. More preferably, the heat conducting member also encloses at least a part of the substrate for the aerosol forming materials. Alternatively, a separate conductive container may be provided to enclose the aerosol forming materials.

in addition, at least a part of the fuel element is preferably provided with a peripheral insulating member, such as a jacket of insulating fibers, the jacket preferably being of resilient, non-burning material at least 0.5 mm thick. This member reduces radial heat loss and assists in retaining and directing heat from the fuel element toward the aerosol generating means and in reducing the fire-causing property of the fuel. The preferred insulating member circumscribes at least part of the fuel element, and advantageously at least part of the aerosol generating means, which helps simulate the fuel of a conventional cigarette. The materials used to insulate the fuel element and the aerosol generating means may be the same as different.

Because the fuel element is relatively short, the hot, burning fire cone is always close to the aerosol generating means, which maximizes heat transfer thereto and the resultant production of aerosol, especially in embodiments which are provided with a multiple passageway fuel element, a heat conducting member, and/or an insulating member. A relatively high density fuel material is used to help insure that the small fuel element will burn long enough to simulate the burning time of a conventional cigarette and that it will provide sufficient energy to generate the required amounts of aerosol. Because the aerosol forming substance is physically separate from the fuel element, it is exposed to substantially lower temperatures than are present in the burning fire cone, thereby minimizing the possibility of thermal degradation of the aerosol former.

The smoking article of the present invention normally is provided with a mouthend piece including means, such as a longitudinal passage, for delivering the volatile material produced by the aerosol generating means to the user. Preferably, the mouthend piece includes a resilient outer member, such as an annular section of cellulose acetate tow, to help simulate the feel of a conventional cigarette. Advantageously, the article has the same overall dimensions as a conventional cigarette, and as a result, the mouthend piece and the aerosol delivery means usually extend over about one-half or more of the length of the article. Alternatively, the fuel element and the aerosol generating means may be produced as a disposable cartridge, i.e., without a built-in mouthend piece or aerosol delivery means, for use with a separate, disposable or reusable mouthend piece.

The smoking article of the present invention also may include a charge or plug of tobacco which may be used to add a tobacco flavor to the aerosol. This tobacco charge may be placed between the aerosol generating means and the mouth end of the article. Preferably, an annular section of tobacco is placed around the periphery of the aerosol generating means where it also acts as an insulating member and helps simulate the aroma and feel of a conventional cigarette. A tobacco charge also may be mixed with, or used as, the substrate for the aerosol forming material. Other substances, such as flavoring agents, also may be incorporated into the article to flavor or otherwise modify the aerosol delivered to the user.

Smoking articles of the present invention normally utilize substantially less fuel on a volume basis, and preferably on a weight basis, than conventional cigarettes to produce acceptable aerosol levels. Moreover, the aerosol delivered to the user normally is lower in pyrolysis and incomplete combustion products, due to the undergraded aerosol from the aerosol generating means and become the short, high density fuel element, especially in embodiments having a plurality of longitudinal passageways, produces substantially reduce amounts of pyrolysis and/or incomplete combustion products in comparison to a conventional cigarette, even when the fuel element comprises tobacco or other cellulosic material.

As used herein, and only for the purposes of this application, "aerosol" is defined to include vapors, gases, particles, and the like, both visible and invisible, and especially those components perceived by the user to be "smoke-like," generated by action of the heat from the burning fuel element upon substances contained within the aerosol generating means, or elsewhere in the article. As so defined, the term "aerosol" also includes volatile flavoring agents and/or pharmacologically or physiologically active agents, irrespective of whether they produce a visible aerosol.

As used herein, the term "conductive heat exchange relationship" is defined as a physical arrangement of the aerosol generating means and the fuel element whereby heat is transferred by conduction from the burning fuel element to the aerosol generating means substantially throughout the burning period of the fuel element. Conductive heat exchange relationships can be achieved by locating the aerosol generating means in contact with the fuel element and in close proximity to the burning portion of the fuel element, and/or utilizing a conductive member to transfer heat from the burning fuel to the aerosol generating means. Preferably both methods of providing conductive heat transfer are used.

As used herein, the term "insulating member" applies to all materials which act primarily as insulators. Preferably, these materials do not burn during use, but they may include slow burning carbons and like materials, and especially materials which fuse during use, such as low temperature grades of glass fibers. Suitable insulators have a thermal conductivity in g-cal/(sec) ($cm^2$) (°C./cm), of less than about 0.05, preferably less than about 0.02, most preferably less than about 0.005. See, Hackh's Chemical Dictionary, 672 (4th ed., 1969) and Lange's Handbook of Chemistry, 10, 272-274 (IIth ed., 1973).

The smoking article of the present invention is described in greater detail in the accompanying drawings and in the detailed description of the invention which follow.

DETAILED DESCRIPTIONS OF THE INVENTION

Figure 1:
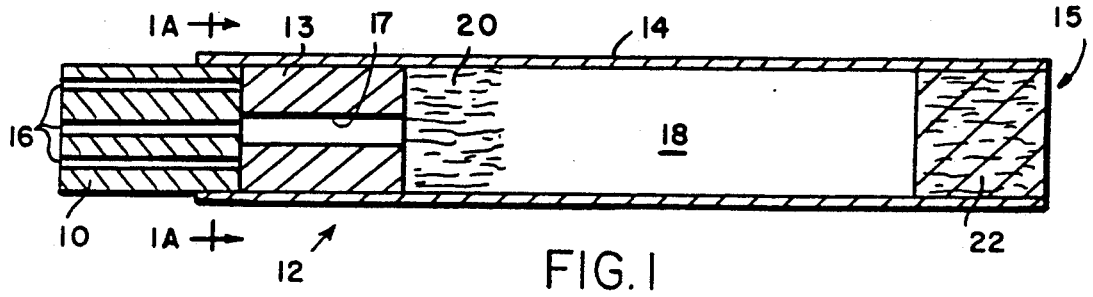
FIGS. 1 through 9 are longitudinal sectional views of various embodiments of the invention.

The embodiment of the invention illustrated in FIG. 1, which preferably has the overall dimensions of a conventional cigarette, includes a short, about 20 mm long, combustible fuel element 10, an abutting aerosol generating means 12, and a foil lined paper tube 14, which forms the mouthend 15 of the article. In this embodiment, fuel element 10 is extruded or molded from a mixture containing comminuted or reconstituted tobacco and/or a tobacco substitute and a minor amount of combustible carbon, and is provided with five longitudinally extending holes 16. See FIG. 1A. The lighting end of fuel element 10 may be tapered or reduced in diameter to improve ease of lighting.

Aerosol generating means 12 includes a porous carbon mass 13 which is provided with one or more passages 17 and is impregnated with one or more aerosol forming materials, such as triethylene glycol, propylene glycol, glycerin, or mixtures thereof.

The foil lined paper tube 14, which forms the mouth-end piece of the article, surrounds aerosol generating means 12 and the rear, nonlighting end of fuel element 10 so that the foil lined tube is spaced about 15 mm for the lighting end of the fuel element. The tube 14 also forms an aerosol delivery passage 18 between the aerosol generating means 12 and mouth end 15 of the article. The presence of foil lined tube 14, which couples the nonlighting end of fuel 10 to aerosol generator 12, increases heat transfer to the aerosol generator. The foil also helps to extinguish the fire cone. When only a small amount of the unburned fuel remains, heat loss through the foil acts as a heat sink which helps to extinguish the fire cone. The foil used in this article is typically an aluminum foil of 0.35 mils (0.0089 mm) in thickness, but the thickness and/or the type of conductor employed may be varied to achieve virtually any desired degree of heat transfer.

The article illustrated in FIG. 1 also includes an optional mass or plug of tobacco 20 to contribute flavor to the aerosol. This tobacco charge 20 may be placed at the mouth end of carbon mass 13, as shown in FIG. 1, or it may be placed in passage 18 at a location spaced from aerosol generator 12. For appearance sake, the article may include an optional low efficiency cellulose acetate filler 22, positioned at or near the mouth end 15.

Figure 2:
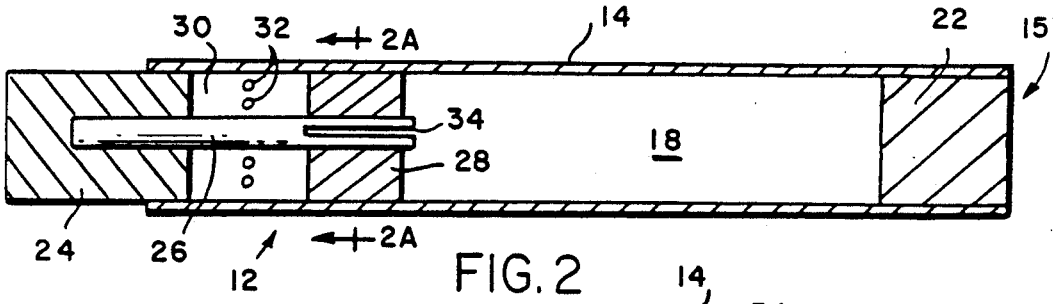

The embodiment of the invention illustrated in FIG. 2, includes a short combustible fuel element 24, about 20 mm long, connected to aerosol generating means 12 by a heat conductive rod 26 and by a foil lined paper tube 14, which also leads to the mouth end 15 of the article. Aerosol generating means 12 includes a thermally stable carbonaceous substrate 28, such as a plug of porous carbon, which is impregnated with one or more aerosol forming materials. This embodiment includes a void space 30 between the fuel element 24 and the substrate 28. The portion of the foil lined tube 14 surrounding this void space includes a plurality of peripheral holes 32 which permit sufficient air to enter the void space to provide appropriate pressure drop.

Figure 2A:
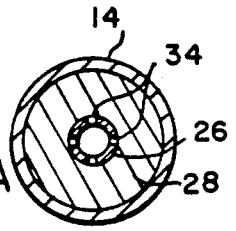
FIG. 2A is a sectional view of the embodiment of FIG. 2, taken along lines 2A—2A in FIG. 2.

As shown in FIGS. 2 and 2A, the heat conducting means includes the conductive rod 26 and the foil lined tube 14, both of which are spaced from the lighting end of the fuel element. The rod 26 is spaced about 5 mm from the lighting end; the tube about 15 mm. The rod 26 is preferably formed at aluminum and has at least one, preferably from 2 to 5, peripheral grooves 34 therein, to allow air passage through the substrate. The article of FIG. 2 has the advantage that the air introduced into void space 30 contains less oxidation products because it is not drawn through the burning fuel.

Figure 3:
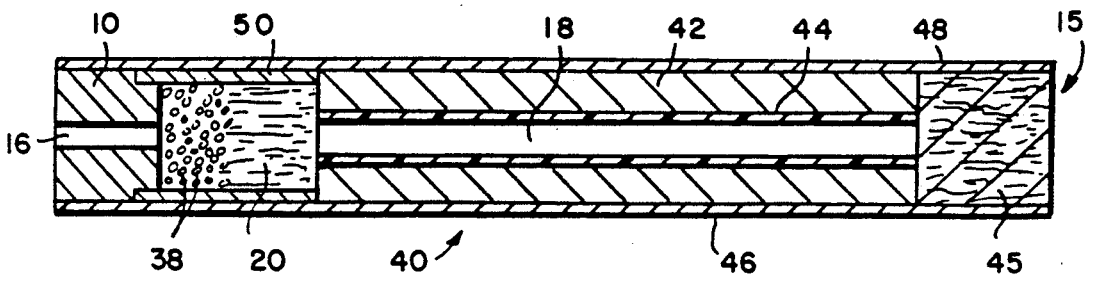

The embodiment illustrated in FIG. 3 includes fuel element 10, about 10 mm long, with a single axial hole 16. Again, the lighting end of the fuel element may be tapered or reduced in diameter to improve ease of lighting. The substrate 38 of the aerosol generator is a granular, thermally stable carbon or alumina impregnated with an aerosol forming material. A mass of tobacco 20 is located immediately behind the substrate. This article is provided with a cellulose acetate tube 40, in place of the foil lined tube of previous embodiments. This tube 40 includes an annular section 42 of resilient cellulose acetate two surrounding an optional plastic tube 44 of polypropylene, Nomex, Mylar, or the like. At the mouth end 15 of this element there is a low efficiency cellulose acetate filter plug 45.

The entire length of the article may be wrapped in cigarette-type paper 46. A cork or white ink coating 48 may be used on the mouth end to simulate tipping. A foil strip 50 is located on the inside of the paper, toward the fuel end of the article. This strip preferably overlaps the rear 2 to 3 mm of the fuel element and extends to the mouth end of the tobacco charge 20. It may be integral with the paper or it may be a separate piece applied before the paper overwrap.

Figure 4:
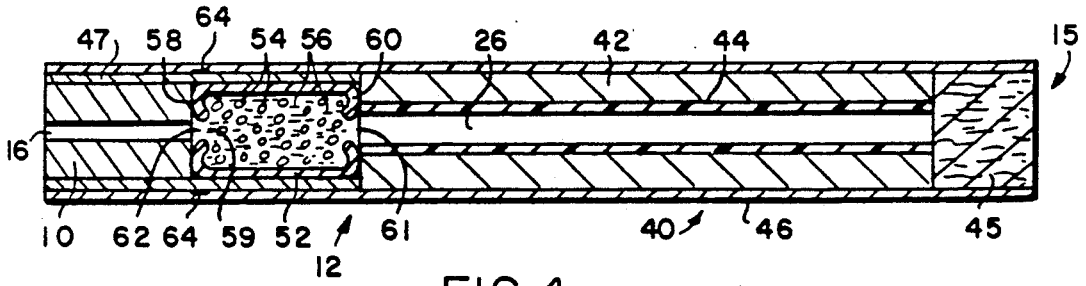

The embodiment of FIG. 4 is similar to that of FIG. 3. In this embodiment, the fuel element 10 is about 15 mm long and the aerosol generating means 12 is formed by an aluminum capsule 52 which is filled with a granular substrate or, as shown in the drawing, a mixture of a granular substrate 54 and tobacco 56. The capsule 52 is crimped at its ends 58, 60 to enclose the material and to inhibit migration of the aerosol former. The crimped end 58, at the fuel end, preferably abuts the rear end of the fuel element to provide for conductive heat transfer.

A void space 62 formed by end 58 also helps to inhibit migration of the aerosol former to the fuel. Longitudinal passageways 59 and 61 are provided to permit the passage of air and the aerosol forming material. Capsule 52 and fuel element 10 may be united by a conventional cigarette paper 47, as illustrated in the drawing, by a perforated ceramic paper, or a metallic strip or tube. If cigarette paper is used, a strip 64 near the rear end of the fuel should be printed or treated with sodium silicate or other known materials which cause the paper to extinguish. If a metal foil is used, it preferably should be spaced about 8 to 12 mm from the lighting end of the fuel. The entire length of the article may be overwrapped with conventional cigarette paper 46.

Figure 5:
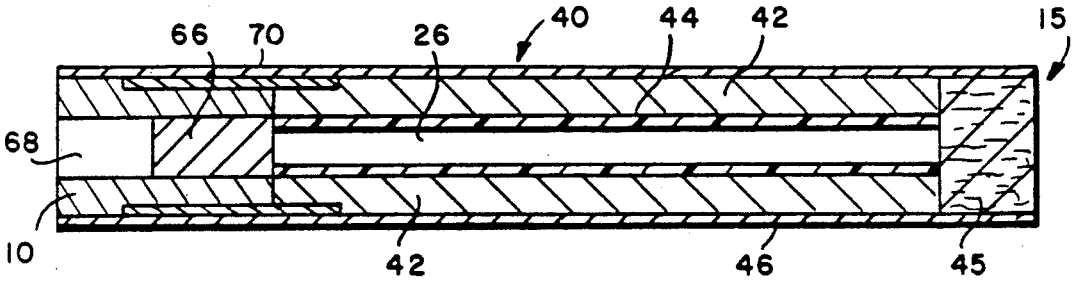

The embodiment shown in FIG. 5 illustrates the use of a substrate 66 impregnated with one or more aerosol forming materials and which is embedded within a large cavity 68 in fuel element 10. In this type of embodiment, the substrate 66 usually is a relatively rigid, porous material. The entire length of the article may be wrapped with conventional cigarette paper 46. This embodiment may also include a foil strip 70 to couple fuel element 10 to the cellulose acetate tube 40 and to help extinguish the fuel. This strip is spaced about 5 to 10 mm from the lighting end.

Figure 6:
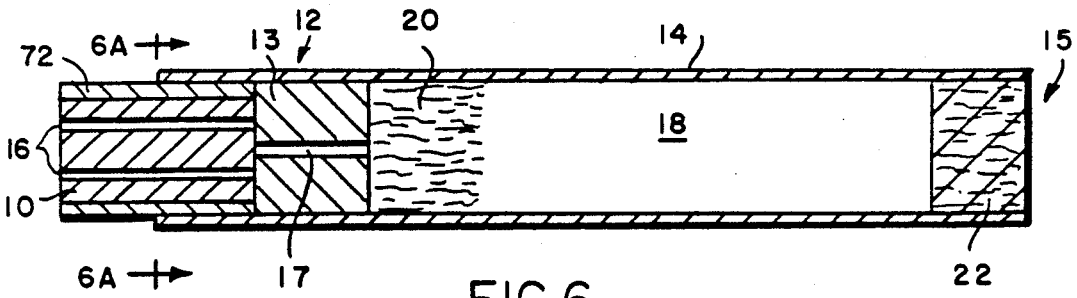
Figure 7:
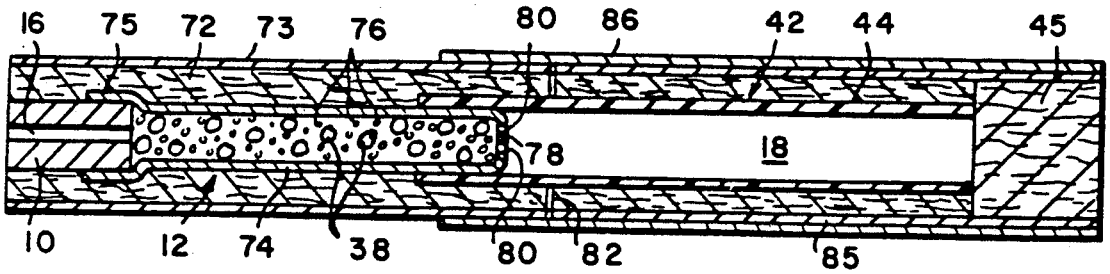
Figure 8:
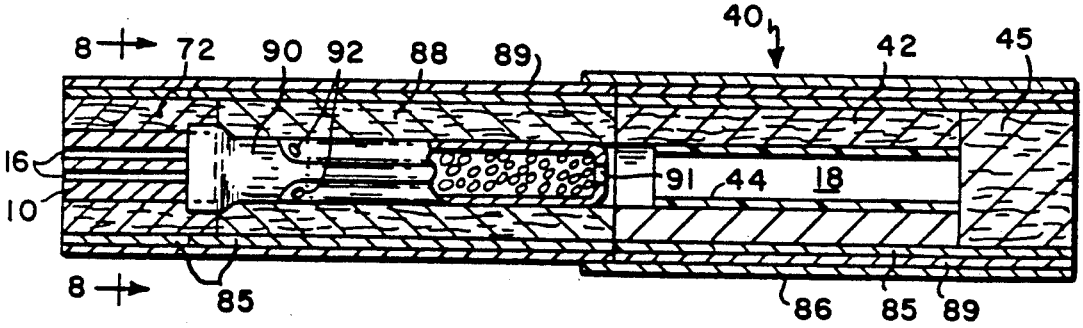

The embodiments shown in FIGS. 6 through 8 include a resilient insulating jacket which encircles or circumscribes the fuel element to insulate and help concentrate the heat in the fuel element. These embodiments also help to reduce any fire causing potential of the burning fire cone and, in some cases, help simulate the feel of a conventional cigarette.

Figure 6A:
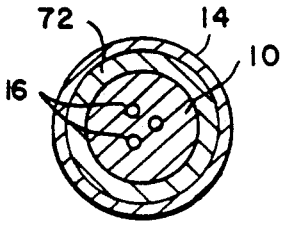
FIG. 6A is a sectional view of the embodiment of FIG. 6, taken along lines 6A—6A in FIG. 6.

In the embodiment of FIG. 6, the fuel element 10 is provided with a plurality of holes 16 and is circumscribed by a resilient jacket 72 about 0.5 mm thick, as shown in FIG. 6A. This jacket is formed of insulating fibers, such as ceramic (e.g., glass) fibers or nonburning carbon or graphite fibers. The aerosol generating means 12 comprises a porous carbon mass 13 having a single, axial hole 17.

Figure 7A:
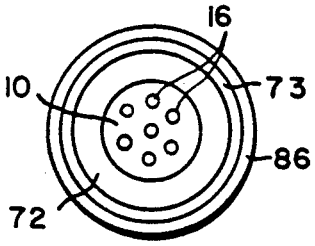
FIGS. 7A, 7B, 7C, and 9A are end views showing various fuel element passageway configurations suitable for use in embodiments of the invention.
Figure 7B:
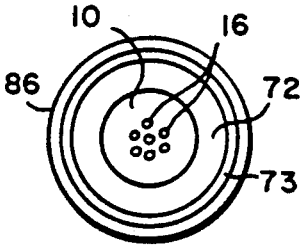
Figure 7C:
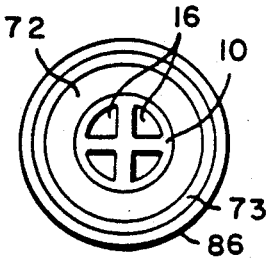

In the embodiment of FIG. 7, the resilient, glass fiber insulating jacket 72 surrounds the periphery of both fuel element 10 and aerosol generating means 12 and is preferably a low temperature material which fuses during use. This jacket 72 is overwrapped with a non-porous paper 73, such as P 878-5 obtained from Kimberly-Clark. In this embodiment, the fuel element is about 15 to 20 mm long and is preferably provided with three or more holes 16 to increase air flow through the fuel. Three suitable passageway arrangements are illustrated in FIGS. 7A, 7B, and 7C.

In this embodiment, the aerosol generating means 12 comprises a metallic container 74 which encloses a granular substrate 38 and/or densified tobacco 76, one or both of which include an aerosol forming material. As illustrated, the open end 75 of container 74 overlaps the rear 3 to 5 mm portion of fuel element 10. Alternatively, the open end 75 may abut the rear end of fuel element 10. The opposite end of container 74 is crimped to form wall 178, which is provided with a plurality of passages 80 to permit passage of gases, tobacco flavors, and/or the aerosol forming material into aerosol delivery passage 18.

Plastic tube 44 abuts or preferably overlaps walled end 78 metallic container 74 and is surrounded by a section of resilient, high density cellulose acetate tow 2. A layer of glue 82, or other material, may be applied to the fuel end of tow 42 to seal the tow and block air flow therethrough. A low efficiency filter plug 45 is provided at the mouth end of the article, and tow 42 and filter plug 45 are preferably overwrapped with a conventional plug wrap paper 85. Another layer of cigarette paper 86 may be used to join the rear portion of the insulating jacket 72 and the tow/filter section.

In a modified version of the embodiment of FIG. 7, the insulating jacket may also be used in lieu of the cellulose acetate tow 42, so that the jacket extends from the lighting end to the filter plug 45. In embodiments of this type, a layer of glue is preferably applied to the annular section of the filter plug which abuts the end of the insulating jacket, or a short annular section of tow is placed between the insulating jacket and the filter piece, with glue applied at either end.

Figure 8A:
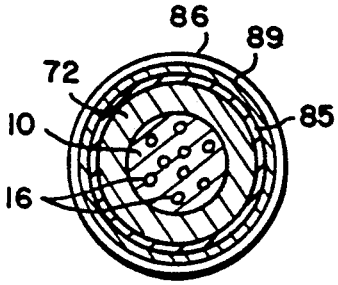
FIGS. 8A is a sectional view of the embodiment of FIG. 8, taken along lines 8—8 in FIG. 8.
Figure 8B:
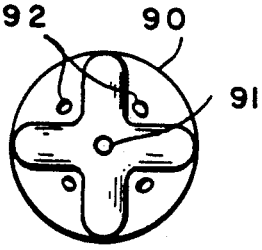
FIG. 8B is an enlarged end view of the metallic container employed in the embodiment of FIG. 8.

FIG. 8 illustrates an embodiment in which a 10 to 15 mm long fuel element 10 is overwrapped with an insulating jacket 72 of glass fibers and the aerosol generating means is circumscribed by a jacket of tobacco 88. The glass fibers used on this embodiment preferably have a softening temperature below about 650° C., such as experimental fibers 6432 and 6437 obtained from Owens-Corning, Toledo, Oh., so that they will fuse during use. The glass fiber and tobacco jackets are each wrapped with a plug wrap 85, such as Ecusta 646, and are joined by an overwrap of cigarette paper 89, such as 780-63-5 or P 878-16-2, obtained from Kimberly-Clark. In this embodiment, the metallic capsule 90 overlaps the rear 3 to 4 mm of the fuel element so that it is spaced about 6 to 12 mm from the lighting end, and the rear portion of the capsule 90 is crimped into a lobe shape, as shown in FIG. 8B. A passage 91 is provided at the mouth end of the capsule, in the center of the capsule. Four additional passages 92 are provided at the transition points between the crimped and uncrimped portion of the capsule. Alternatively, the rear portion of the capsule may have a rectangular or square cross section in lieu of the lobes, or a simple tubular capsule with a crimped mouth end may be employed, with or without peripheral passages 92. A suitable passageway arrangement is illustrated in FIG. 8A.

At the mouth end of tobacco jacket 88 is a mouthend piece 40 including an annular section of cellulose acetate tow 42, a plastic tube 44, a low efficiency filter piece 45, and layers of cigarette paper 85 and 89. The mouth end piece 40 is joined to the jacketed fuel/capsule end by an overwrapping layer of tipping paper 86. As illustrated, the capsule end of plastic tube 44 is spaced from the capsule 90. Thus, the hot vapors flowing through passages 92 pass through tobacco jacket 88, where volatile components in the tobacco are vaporized or extracted, and then into passage 18 where the tobacco jacket abuts the cellulose acetate tow 42.

In embodiments of this type having low density fuel insulating jackets 72, some air and gases pass through jacket 72 and into tobacco jacket 88. Thus, the peripheral passage 92 in the capsule may not be needed to extract tobacco flavor from the tobacco jacket 88.

Figure 9:
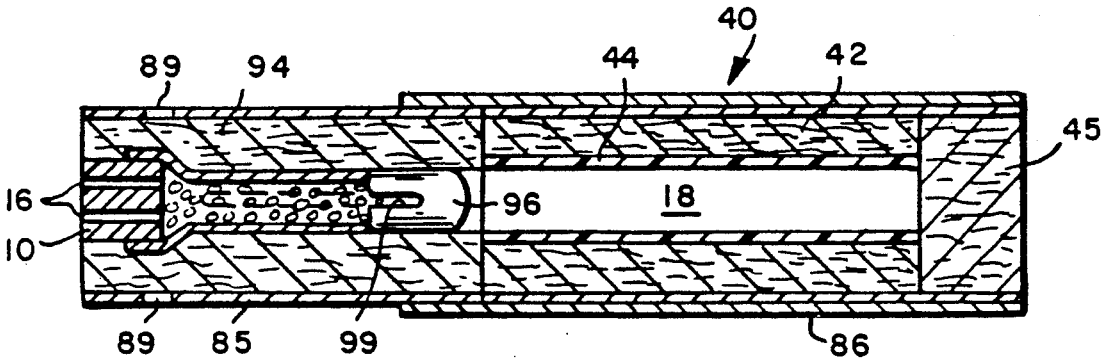

In the embodiment of FIG. 9, the jackent 94 comprises tobacco or an admixture of tobacco and insulating fibers, such as glass fibers. As shown, the tobacco jacket 94 extends just beyond the mouth end of metallic container 96. Alternatively, it may extend over the entire length of the article, up to the mouth end filter piece. In embodiments of this type, container 96 is preferably provided with one or more longitudinal slots 99 on its periphery (preferably two slots 180° apart) so that vapors from the aerosol generator pass through the annular section of tobacco which surrounds the aerosol generator to extract tobacco flavors before entering passage 18.

As illustrated, the tobacco at the fuel element end of jacket 94 is compressed. This aids in reducing air flow through the tobacco, thereby reducing the burn potential thereof. In addition, the container 96 aids in extinguishing the tobacco by acting as a heat sink. This heat sink effect helps quench any burning of the tobacco surrounding the capsule, and it also helps to evenly distribute heat to the tobacco around the aerosol generating means, thereby aiding in the release of tobacco flavor components. In addition, it may be desirable to treat the portion of the cigarette paper overwrap 85, 89 near the rear end of the fuel with a material, such as sodium silicate, to help extinguish the tobacco, so that it will not burn significantly beyond the exposed portion of the fuel element. Alternatively, the tobacco itself may be treated with a burn modifier to prevent burning of the tobacco which surrounds the aerosol generator.

Upon lighting any of the aforesaid embodiments, the fuel element burns, generating the heat used to volatilize the aerosol forming material or materials present in the aerosol generating means. These volatile materials are then drawn toward the mouthend, especially during puffing, and into the user's mouth, akin to the smoke of a conventional cigarette.

Because the fuel element is relatively short, the hot, burning fire cone is always close to the aerosol generating body, which maximizes heat transfer to the aerosol generating means and any optional tobacco charges, and the resultant production of aerosol and optional tobacco flavor, especially when the preferred heat conducting member is used. Because the fuel element is short, there is never a long section of nonburning fuel to act as a heat sink, as was common in previous thermal aerosol articles. The small fuel source also tends to minimize the amount of incomplete combustion or pyrolysis products, especially in embodiments which contain carbon and/or multiple passageways.

Heat transfer, and therefor aerosol delivery, also is enhanced by the use of passageways through the fuel, which draw hot air to the aerosol generator, especially during puffing. Heat transfer also is enhanced by the preferred heat conducting member, which is spaced or recessed from the lighting end of the fuel element to avoid interference with lighting and burning of the fuel and to avoid any unsightly protrusion, even after use. In addition, the preferred insulating member tends to confine, direct, and concentrate the heat toward the central core of the article, thereby increasing the heat transferred to the aerosol forming substance.

Because the aerosol forming material is physically separate from the fuel element, it is exposed to substantially lower temperatures than are present in the burning fire cone. This minimizes the possibility of thermal degradation of the aerosol former and attendant off taste. This also results in aerosol production during puffing, but minimal aerosol production from the aerosol generating means during smolder.e In the preferred embodiments of the invention, the short fuel element, the recessed heat conducting member, the insulating member, and/or the passages in the fuel cooperate with the aerosol generator to provide a system which is capable of producing substantial quantities of aerosol and optional tobacco flavor, on virtually every puff. The close proximity of the fire cone to the aerosol generator after a few puffs, together with the conducting member, the insulating member, and/or the multiple passageways in the fuel element, results in high heat delivery both during puffing and during the relatively long period of smolder between puffs.

While not wishing to be bound by theory, it is believed that the aerosol generating means is maintained at a relatively high temperature between puffs, and that the additional heat delivered during puffs, which is significantly increased by the preferred passageways in the fuel element, is primarily utilized to vaporize the aerosol forming material. This increased heat transfer makes more efficient use of the available fuel energy, reduces the amount of fuel needed, and helps deliver early aerosol.

Furthermore, by the appropriate selection of the fuel element composition, the number, size, configuration, and arrangement of fuel element passageways, the insulating jacket, the paper overwrap, and/or the heat conducting means, it is possible to control the burn properties of the fuel source to a substantial degree. This provides significant control over the heat transferred to the aerosol generator, which in turn, can be used to alter the number of puffs and/or the amount of aerosol delivered to the user.

In general, the combustible fuel elements which may be employed in practicing the invention are less than about 30 mm long. Preferably the fuel element is about 20 mm or less, more preferably about 15 mm or less in length. Advantageously, the diameter of the fuel element is about 8 mm or less, preferably between about 3 and 7 mm, and more preferably between about 4 to 6 mm. The density of the fuel elements which may be employed herein range from about 0.5 g/cc to about 1.5 g/cc as measured, e.g., by mercury displacement. Preferably, the density is greater than 0.7 g/cc., more preferably greater than 0.8 g/cc. In most cases, a high density material is desired because it helps to ensure that the fuel element will burn long enough to simulate the burning time of a conventional cigarette and that it will provide sufficient energy to generate the required amount of aerosol.

The fuel elements employed herein are advantageously molded or extruded from comminuted tobacco, reconstituted tobacco, or tobacco substitute materials, such as modified cellulosic materials, degraded or prepyrolyzed tobacco, and the like. Suitable materials include those described in U.S. Pat. No. 4,347,855 to Lanzilotti et al., U.S. Pat. No. 3,931,824 to Miano et al., and U.S. Pat. Nos. 3,885,574 and 4,008,723 to Borthwick et al. and in Sittig, *Tobacco Substitutes*, Noyes Data Corp. (1976). Other suitable combustible materials may be employed, as long as they burn long enough to simulate the burning time of a conventional cigarette and generate sufficient heat for the aerosol generating means to produce the desired level of aerosol from the aerosol forming material.

Preferred fuel elements normally include combustible carbon materials, such as those obtained by the pyrolysis or carbonization of cellulosic materials, such as wood, cotton, rayon, tobacco, coconut, paper, and the like. In most cases, combustible carbon is desirable because of its high heat generating capacity and because it produces only minimal amounts of incomplete combustion products. Preferably, the carbon content of the fuel element is about 20 to 40% by weight, or more.

The most preferred fuel elements useful in practicing this invention are carbonaceous fuel elements (i.e., fuel elements primarily comprising carbon) which are described and claimed in copending applications Ser. No. 650,604, filed Sept. 14, 1984 and Ser. No. 769,532, filed Aug. 26, 1985. Carbonaceous fuel elements are particularly advantageous because they produce minimal pyrolysis and incomplete combustion products, produce little or no visible sidestream smoke, and minimal ash, and have high heat capacity. In especially preferred embodiments, the aerosol delivered to the user has no significant mutagenic activity as measured by the Ames test. See Ames et al., *Mut. Res.*, 31:347–364 (1975); Nagas et al., *Mut. Res.*, 42:335 (1977).

Burn additives or combustion modifying agents also may be incorporated into the fuel to provide the appropriate burning and glow characteristics. If desired, fillers, such as diatomaceous earth, and binders, such as sodium carboxymethyl cellulose (SCMC), also may be incorporated into the fuel. Flavorants, such as tobacco extracts, may be incorporated into the fuel to add a tobacco or other flavor to the aerosol.

Preferably, the fuel element is provided with one or more longitudinally extending passageways. These passageways help to control transfer of heat from the fuel element to the aerosol generating means, which is important both in terms of transferring enough heat to produce sufficient aerosol and in terms of avoiding the transfer of so much heat that the aerosol former is degraded. Generally, these passageways provide porosity and increase early heat transfer to the substrate by increasing the amount of hot gases which reach the substrate. They also tend to increase the rate of burning.

Figure 1A:
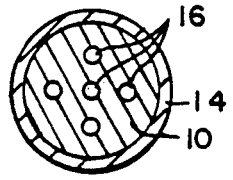
FIG. 1A is a sectional view of the embodiment of FIG. 1, taken along lines 1A—A1 in FIG. 1.
Figure 9A:
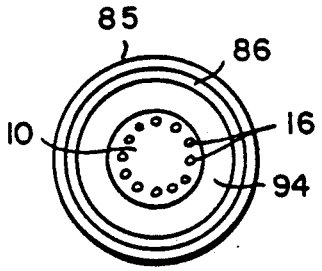

Generally, a large number of passageways, e.g., about 5 to 9 or more, especially with a relatively wide spacing between the passageways, as in FIGS. 1A, 7A, and 9A, produce high convective heat transfer, which leads to high aerosol delivery. A large number of passageways also generally helps assure ease of lighting.

High convective heat transfer tends to produce a higher CO output in the mainstream. To reduce CO levels, fewer passageways or a higher density fuel element may be employed, but such changes generally tend to make the fuel element more difficult to ignite, and to decrease the convective heat transfer, thereby lowering the aerosol delivery rate and amount. However, it has been discovered that with passageway arrangements which are closely spaced, as in FIG. 7B, such that they burn out or coalesce to form one passageway, at least at the lighting end, the amount of CO in the combustion products is generally lower than in the same, but widely spaced, passageway arrangement.

The optimum arrangement, configuration, and number of fuel element passageways should delivery a steady and high supply of aerosol, allow for easy ignition, and produce low CO. Various combinations have been examined for passageway arrangement/configuration and/or number in carbonaceous fuel elements used in various embodiments of the invention. In general, it has been discovered that fuel elements having from about 5 to 9 passageways, relatively closely spaced such that they burn away into one large passageway, at least at the lighting end of the fuel element, appear to most closely satisfy the requirements of a preferred fuel element for use in this invention, especially for the preferred carbonaceous fuel elements. However, it is believed that this phenomenon also occurs with the various noncarbonaceous fuel elements which may be employed in practicing the invention.

Variables which affect the rate at which the fuel element passageways will coalesce upon burning include the density and composition of the fuel element, the size, shape, and number of passageways, the distance between the passageways, and the arrangement thereof. For example, for a 0.85 g/cc carbonaceous fuel source having seven passageways of about 0.5 mm, the passageways should be located within a core diameter, i.e., the diameter of the smallest circle which will circumscribe the outer edge of the passageways, between about 1.6 mm and 2.5 mm in order for them to coalesce into a single passageway during burning. However, when the diameter of the seven passageways is increased to about 0.6 mm, the core diameter which will coalesce during burning increases to about 2.1 mm to about 3.0 mm.

Figure 9B:
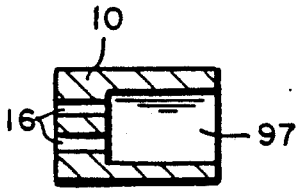
FIG. 9B is a longitudinal sectional view of a preferred fuel element passageway configuration suitable for use in embodiments of the invention.

Another preferred fuel element passageway arrangement useful in embodiments of the invention is the configuration illustrated in FIG. 9B, which has been found to be particularly advantageous for low CO delivery and ease of lighting. In this preferred arrangement, a short section at the lighting end of the fuel element is provided with a plurality of passages, preferably from about 5 to 9, which merge into a large cavity 97 which extends to the mouth end of the fuel element. The plurality of passages at the lighting end provide the large surface area desired for ease of lighting and early aerosol delivery. The cavity, which may be from about 30% to 95%, preferably more than 50%, of the length of the fuel element, helps assure uniform heat transfer to the aerosol generating means and tends to delivery low CO to the mainstream.

The aerosol generating means used in practicing the invention is physically separate from the fuel element. By physically separate it is meant that the substrate, container, or chamber which contains the aerosol forming materials is not mixed with, or a part of, the burning fuel element. As noted previously, this arrangement helps reduce or eliminate thermal degradation of the aerosol forming material and the presence of sidestream smoke. While not a part of the fuel, the aerosol generating means is preferably in a conductive heat exchange relationship with the fuel element, and preferably abuts or is adjacent to the fuel element. More preferably, the conductive heat exchange relationship is achieved by a heat conducting member, such as a metal tube or foil, which is preferably recessed or spaced from the lighting end of the fuel.

Preferably, the aerosol generating means includes one or more thermally stable materials which carry one or more aerosol forming materials. As used herein, a thermally stable material is one capable of withstanding the high temperatures, e.g., 400° C.-600° C., which exist near the fuel without decomposition or burning. While not preferred, other aerosol generating means, such as heat rupturable microcapsules, or solid aerosol forming substances, are within the scope of the invention, provided they are capable of releasing sufficient aerosol forming vapors to satisfactorily resemble tobacco smoke.

Thermally stable materials which may be used as a substrate or carrier for the aerosol forming materials are well known to those skilled in the art. Useful substrates should be porous and must be capable of retaining an aerosol forming material when not in use and capable of releasing a potential aerosol forming vapor upon heating by the fuel element. Substrates, especially particulates, may be placed within a container, preferably formed from a conductive material.

Useful thermally stable materials include thermally stable adsorbent carbons, such as porous grade carbons, graphite, activated, or nonactivated carbons, and the like. Other suitable materials include inorganic solids such as ceramics, glass, alumina, vermiculite, clays such as bentonite, and the like. Preferred carbon substrate materials include porous carbons such as PC-25 and PG-60 available from Union Carbide, and SGL carbon available from Calgon. A preferred alumina substrate is SMR-14-1896, available from the Davidson Chemical Division of W. R. Grace & Co., which is sintered at elevated temperatures, e.g., greater than about 1000° C., washed, and dried prior to use.

It has been found that suitable particulate substrates also may be formed from carbon, tobacco, or mixtures of carbon and tobacco, into densified particles in a one-step process using a machine made by Fuji Paudal KK of Japan, and sold under the trade name of "Marumerizer". This apparatus is described in German Patent No. 1,294,351 and U.S. Pat. No. 3,277,520 (now reissued as U.S. Pat. No. Re. 27,214) as well as Japanese published specification No. 8684/1967.

The aerosol generating means used in the invention is advantageously spaced no more than about 40 mm, preferably no more than 30 mm, most preferably no more than 20 mm from the lighting end of the fuel element. The aerosol generator may vary in length from about 2 mm to about 60 mm, preferably from about 5 mm to 40 mm, and most preferably from about 20 mm to 35 mm. The diameter of the aerosol generating means may vary from about 2 mm to about 8 mm, preferably from about 3 to 6 mm. If a non-particulate substrate is used, it may be provided with one or more holes, to increase the surface area of the substrate, and to increase air flow and heat transfer.

The aerosol forming material or materials used in the invention must be capable of forming an aerosol at the temperatures present in the aerosol generating means when heated by the burning fuel element. Such materials preferably will be composed of carbon, hydrogen and oxygen, but they may include other materials. The aerosol forming materials can be in solid, semisolid, or liquid form. The boiling point of the material and/or the mixture of materials can range up to about 500° C. Substances having these characteristics include polyhydric alcohols, such as glycerin and propylene glycol, as well as aliphatic esters of mono-, di-, or poly-carboxylic acids, such as methyl stearate, dodecandioate, dimethyl tetradodecandioate, and others.

The preferred aerosol forming materials are polyhydric alcohols, or mixtures of polyhydric alcohols. Especially preferred aerosol formers are glycerin, propylene glycol, triethylene glycol, or mixtures thereof.

The aerosol forming material may be dispersed on or within the aerosol generating means in a concentration sufficient to permeate or coat the substrate, carrier, or container. For example, the aerosol forming substance may be applied full strength or in a dilute solution by dipping, spraying, vapor deposition, or similar techniques. Solid aerosol forming components may be admixed with the substrate and distributed evenly throughout prior to formation.

While the loading of the aerosol forming material will vary from carrier to carrier and from aerosol forming material to aerosol forming material, the amount of liquid aerosol forming materials may generally vary from about 20 mg to about 120 mg, preferably from about 35 mg to about 85 mg, and most preferably from about 45 mg to about 65 mg. As much as possible of the aerosol former carried on the aerosol generating means should be delivered to the user as WTPM. Preferably, above about 2 weight percent, more preferably above about 15 weight percent, and most preferably above about 20 weight percent of the aerosol former carried on the aerosol generating means is delivered to the user as WTPM.

The aerosol generating means also may include one or more volatile flavoring agents, such as menthol, vanillin, artifical coffee, tobacco extracts, nicotine, caffeine, liquors, and other agents which impart flavor to the aerosol. It also may include any other desirable volatile solid or liquid materials. Alternatively, these optional agents may be placed between the aerosol generating means and the mouthend, such as in a separate substrate or chamber in the passage which leads from the aerosol generating means to the mouth-end, or in the optional tobacco charge. If desired, these volatile agents may be used in lieu of part, or all, of the aerosol forming material, so that the article delivery a nonaerosol flavor or other material to the user.

One particularly preferred aerosol generating means comprises the aforesaid alumina substrate containing spray dried tobacco extract, tobacco flavor modifiers, such as levulinic acid, one or more flavoring agents, and an aerosol forming material, such as glycerin. This substrate may be mixed with densified tobacco particles, such as those produced on a "Marumerizer", which particles also may be impregnated with an aerosol forming material.

Articles of the type disclosed herein may be used, or may be modified for use, as drug delivery articles, for delivery of volatile pharmacologically or physiologically active materials such as ephedrine, metaproterenol, terbutaline or the like.

As shown in the illustrated embodiments, the smoking article of the present invention also may include a charge or plug of tobacco or a tobacco containing material downstream from the fuel element, which may be used to add a tobacco flavor to the aerosol. In such cases, hot vapors are swept through the tobacco to extract and vaporize the volatile components in the tobacco, without combustion or substantial pyrolysis. One preferred location for the tobacco charge is around the periphery of the aerosol generating means, as shown in FIGS. 8 and 9, which increases heat transfer to the tobacco, especially in embodiments which employ a heat conducting member or conductive container between the aerosol forming material and the peripheral tobacco jacket. The tobacco in these embodiments also acts as an insulating member for the aerosol generator and helps simulate the feel and aroma of a conventional cigarette. Another preferred location for the tobacco charge is within the aerosol generating means, where tobacco or densified tobacco particles may be mixed with, or used in lieu of, the substrate for the aerosol forming materials.

The tobacco containing material may contain any tobacco available to the skilled artisan, such as Burley, Flue Cured, Turkish, reconstituted tobacco, extruded or densified tobacco mixtures, tobacco containing sheets and the like. Advantageously, a blend of tobaccos may be used to contribute a greater variety of flavors. The tobacco containing material may also include conventional tobacco additives, such as fillers, casings, reinforcing agents, such as glass fibers, humectants, and the like. Flavor agents may likewise be added to the tobacco material, as well as flavor modifying agents.

The heat conducting member preferably employed in practicing this invention is typically a metallic (e.g., aluminum) tube, strip, or foil varying in thickness from less than about 0.01 mm to about 0.2 mm or more. The thickness, shape, and/or type of conducting material (e.g., other metals or Grafoil from Union Carbide) may be varied to achieve virtually any desired degree of heat transfer. In general, the heat conducting member should be sufficiently recessed to avoid any interference with the lighting of the fuel element, but close enough to the lighting end to provide conductive heat transfer on the early and middle puffs.

As shown in the illustrated embodiments, the heat conducting member preferably contacts or overlaps the rear portion of the fuel element and at least a portion of the aerosol generating means and is recessed or spaced from the lighting end, by at least about 3 mm or more, preferably by about 5 mm or more. Preferably, the heat conducting member extends over no more than about one-half the length of the fuel element. More preferably, the heat conducting member overlaps or otherwise contacts no more than about the rear 5 mm of the fuel element. Preferred recessed members of this type do not interfere with the lighting or burning of the fuel element. Preferred recessed conducting members also help to extinguish the fuel when it burns back to the point of contact by the conductor, by acting as a heat sink, and do not protrude, even after the fuel has been consumed.

Preferably, the heat conducting member also forms a conductive container which encloses the aerosol forming materials. Alternatively, a separate conductive container may be provided, especially in embodiments which employ particulate substrates or semi-liquid aerosol forming materials. In addition to acting as a container for the aerosol forming materials, the conductive container improves heat distribution to the aerosol forming materials and the preferred peripheral tobacco jacket and helps to prevent migration of the aerosol former to other components of the article. The container also provides a means for controlling the pressure drop through the article, by varying the number, size, and/or position of the passageways through which the aerosol former is delivered to the mouthend piece of the article. Moreover, in embodiments with a tobacco jacket around the periphery of the aerosol generating means, the container may be provided with peripheral passages or slots to control and direct the flow of vapors through the tobacco. The use of a container also simplifies the manufacture of the article by reducing the number of necessary elements and/or manufacturing steps.

The insulating members which may be employed in practicing the invention are preferably formed into a resilient jacket from one or more layers of an insulating material. Advantageously, this jacket is at least 0.5 mm thick, preferably at least 1 mm thick, and more preferably from about 1.5 to about 2 mm thick. Preferably, the jacket extends over more than half the length of the fuel element. More preferably, it extends over substantially the entire outer periphery of the fuel element and all or a portion of the aerosol generating means. As shown in the embodiment of FIG. 8, different materials may be used to insulate these two components of the article.

Insulating members which may be used in accordance with the present invention generally comprise inorganic or organic fibers such as those made out of glass, alumina, silica, vitreous materials, mineral wool, carbons, silicons, boron, organic polymers, cellulosics, and the like, including mixtures of these materials. Nonfibrous insulating materials, such as silica aerogel, pearlite, glass, and the like, formed in mats, strips or other shapes, may also be used. Preferred insulating members are resilient, to help simulate the feel of a conventional cigarette. Preferred insulating materials should fuse during use and should have a softening temperature below about 650°-700° C. Preferred insulating materials also should not burn during use. However, slow burning carbons and like materials may be employed. These materials act primarily as an insulating jacket, retaining and directing a significant portion of the heat formed by the burning fuel element ot the aerosol generating means. Because the isulating jacket becomes hot adjacent to the burning fuel element, to a limited extent, it also may conduct heat toward the aerosol generating means.

Currently preferred insulating materials for the fuel element include ceramic fibers, such as glass fibers. Two suitable glass fibers are available from the Manning Paper Company of Troy, N.Y., under the designations Manniglas 1000 and Manniglas 1200. Preferred glass fiber materials have a low softening point, e.g., below about 650° C., using ASTM test method C 338-73. Preferred glass fibers include experimental materials produced by Owens-Corning of Toledo, Ohio under the designations 6432 and 6437, which have a softening point of about 640° C. and fuse during use.

Several commercially available inorganic fibers are prepared with a binder, e.g., PVA, which acts to maintain structural integrity during handling. These binders, which would exhibit a harsh aroma upon heating, should be removed, e.g., by heating in air at about 650° C. for up to about 15 min. before use. If desired, pectin, at about 3 wt. percent, may be added to the fibers to provide mechanical strength to the jacket without contributing harsh aromas.

Alternatively, the insulating material may be replaced, in whole or in part, by tobacco, either loosely packed or tightly packed. The use of tobacco as a substitute for part or all of the insulating jacket serves an additional function by adding tobacco flavors to the mainstream aerosol and producing a tobacco sidestream aroma, in addition to acting as an insulator. In preferred embodiments where the tobacco jacket encompasses the aerosol generating means, the jacket acts as a nonburning insulator, as well as contributing tobacco flavors to the mainstream aerosol. In embodiments where the tobacco encircles the fuel, the tobacco is preferably consumed only to the extent that the fuel source is consumed, i.e., up to about the point of contact between the fuel element and the aerosol generating means. This may be achieved by compressing the tobacco around the fuel element and/or using a conductive heat sink, as in the embodiment of FIG. 9. it also may be achieved by treating the cigarette paper overwrap and/or the tobacco with materials which help extinguish the tobacco at the point where it overlaps the aerosol generating means.

When the insulating member comprises fibrous materials other than tobacco, there may be employed a barrier means between the insulating member and the mouth end of the article. One such barrier means comprises an annular member of high density cellulose acetate tow which abuts the fibrous insulating means and which is sealed, at either end, with, for example, glue, to block air flow through the tow.

in most embodiments of the invention, the fuel/aerosol generating means combination will be attached to a mouthend piece, such as a foil lined paper or cellulose acetate/plastic tubes illustrated in the Figures, although a mouthend piece may be provided separately, e.g., in the form of a cigarette holder. This element of the article provides the passageway which channels the vaporized aerosol forming materials into the mouth of the user. Due to its length, preferably about 35 to 50 mm or more, it also keeps the hot fire cone away from the mouth and fingers of the user and provides sufficient time for the hot aerosol to form and cool before it reaches the user.

Suitable mouthend pieces should be inert with respect to the aerosol forming substances, may have a water or liquid proof inner layer, should offer minimum aerosol loss by condensation or filtration, and should be capable of withstanding the temperature at the interface with the other elements of the article. Preferred mouthend pieces include the cellulose-acetate tube employed in many of the illustrated embodiments which acts as a resilient outer member and helps simulate the feel of a conventional cigarette in the mouth end portion of the article. Other suitable mouthend pieces will be apparent to those of ordinary skill in the art.

Mouthend pieces useful in articles of the invention may include an optional "filter" tip, which is used to give the article the appearance of the conventional filtered cigarette. Such filters include low efficiency cellulose acetate filters and hollow or baffled plastic filters, such as those made of polypropylene. Such filters do not appreciably interfere with aerosol delivery.

The entire length of article or any portion thereof may be overwrapped with cigarette paper. Preferred papers at the fuel element end should not openly flame during burning of the fuel element. In addition, the paper should have controllable smolder properties and should produce a grey, cigarette-like ash.

In those embodiments utilizing an insulating jacket wherein the paper burns away from the jacketed fuel element, maximum heat transfer is achieved because air flow to the fuel source is not restricted. Hoowever, papers can be designed to remain wholly or partially intact upon exposure to heat from the burning fuel element. Such papers provide restricted air flow to the burning fuel element, thereby helping to control the temperature at which the fuel element burns and the subsequent heat transfer to the aerosol generating means.

To reduce the burning rate and temperature of the fuel element, thereby maintaining a low $CO/CO_2$ ratio, a non-porous or zero-porosity paper treated to be slightly porous, e.g., non-combustible mica paper with a plurality of holes therein, may be employed as the overwrap layer. Such a paper controls heat delivery, especially in the middle puffs (i.e., puffs 4 through 6).

To maximized aerosol delivery which otherwise would be diluted by radial (i.e., outside ) air infiltration through the article, a non-porous paper may be used from the aerosol generating means to the mouth end.

Papers such as these are known in the cigarette paper art and combinations of such papers may be employed to produce various functional effects. Preferred papers used in the articles of the present invention include Ecusta 01788 and 646 plug wrap manufactured by Ecusta of Pisgah Forest, N.C., and Kimberly-Clark's KC-63-5, P 878-5, P 878-16-2, and 780-63-5 papers.

Preferred embodiments of the invention are capable of delivering at least 0.6 mg or aerosol, measured as wet total particulate matter (WTPM), in the first 3 puffs, when smoked under FTC smoking conditions. (FTC smoking ocnditions consist of two seconds of puffing (35 ml total volume) separated by 58 seconds of smolder.) More preferred embodiments of the invention are capable of delivering 1.5 mg or more of aerosol in the first 3 puffs. Most preferably, embodiments of the invention are capable of delivering 3 mg or more of aerosol in the first 3 puffs when smoked under FTC smoking conditions. Moreover, preferred embodiments of the invention deliver an average of at least about 0.8 mg of wet total particulate matter per puff for at least about 6 puffs, preferably for at least about 10 puffs, under FTC smoking conditions.

one particularly preferred embodiment of the invention, of the type illustrated in FIG. 8, may be prepared in the following manner:

Hardwood paper, such as Grand Prairie Canadian Kraft paper obtained from Buckeye Cellulose Corp., Memphis, Tenn., is shredded and placed inside a furnace. The furnace is flushed with nitrogen, and the furnace temperature is slowly raised, at about 5–15° C. per hour, to about 750° C., and held at that temperature for a time sufficient to insure that all of the material in the furnance reaches 750° C. for about 15 minutes. The carbonized material is then cooled and ground to a mesh size of minus 200 or less. The powdered material is then heated to a temperature of 650° C. to 750° C. to remove volatiles. After cooling, the powdered material is used to form a mixture with a SCMC binder (10 wt. percent), $K_2CO_3$ (1 wt. percent), and from 10 to 20 wt. percent of a spray dried water extract of tobacco. Sufficient water is used to form a stiff paste which is extruded through a 4.6 mm diameter die designed to form 7 longitudinal holes with a diameter of 0.6 mm. These holes are arranged so that all of the holes are within about 1.3 mm of the axis of the fuel element, with a spacing between the holes of about 4.5 mm and an apparent (bulk) density of about 0.86 g/cc, is dried at about 95° C. to reduce the moisture content to about 2 to 4%, and is cut into 10 mm long fuel elements.

The metallic container or capsule is formed from a 30 mm long spirally wound or drawn aluminum tube. This tube is about 0.1 mm thick and 4.5 mm in diameter. The rear 2 mm of the tube is crimped to seal the mouth end of the capsule. At the mouth end, four equally spaced grooves are indented in the side of the capsule, each to a depth of about 0.75 mm to afford a "lobe-shaped" capsule similar to that illustrated in FIG. 8B. This is accomplished by inserting the capsule into a die having four equally spaced wheels of about 0.75 mm depth located such that the rear 18 mm of the capsule is grooved to afford four equally spaced channels. Four holes (each about 0.72 mm diameter) are made in the capsule at the transition between the ungrooved portion of the capsule and each of the grooves (as shown at 92 in FIG. 8B). In additon, a central hole of about the same diameter is made in the sealed end of the capsule, approximately 17 mm from the holes at the fuel end of the grooves.

The capsule is filled with a 1:1 mixture of densified (e.g., Marumerized) flue cured tobacco having a density of about 0.8 g/cc and containing about 15% by weight of glycerin and a treated alumina substrate. The alumina, SMR-14-1896, from the Davidson Chemical Division of W.R. Grace & Co., is sintered at a soak temperature above about 1400° C. to 1550° C., for about one hour, and cooled. The alumina is then washed with water and dried. The alumina (640 mg) is treated with an aqueous solution containing 107 mg of a spray dried water extract of flue cured tobacco, and dried to a moisture content of from about 1 to 5, preferably about 3.5, weight percent. This material is then treated with a mixture of 233 mg of glycerin and 17 mg of a flavor component obtained form Firmenich, Geneva, Switzerland, under the designation T69-22.

The fuel element is inserted into the open end of the filled capsule to a depth of about 3 mm. The fuel element-capsule combination is overwrapped at the fuel element end with a 10 mm long, glass fiber jacket of Owens-Corning 6432 (having a softening point of about 640° C.), with 3 wt. percent pectin binder, to a diameter of about 8 mm, which is overwrapped with Ecusta 646 plug wrap.

An 8 mm diameter tobacco filler cigarette rod with an Ecusta 646 plug wrap overwrap is cut to a 28 mm length and modified to have a longitudinal hole of about 4.5 mm diameter in the center. The jacketed fuel element-capsule combination is inserted into the hole in the tobacco rod until the glass fiber jacket abuts the tobacco. The glass fiber and tobacco sections are overwrapped with Kimberly-Clark P 878-16-2 paper.

A 30 mm long cellulose acetate tow mouthend piece overwrapped with Ecusta 646 and containing a 28 mm long polypropylene tube, recessed 2 mm from the fuel element end, as illustrated in FIG. 8, is joined to a 10 mm long low efficiency cellulose acetate filter element having an overwrap of Ecusta 646 plug wrap by a layer of KOP-878-16-12 paper. This mouthend piece section is joined to the jacketed fuel element-capsule section by tipping paper.

During use, heated air and gases will enter the tobacco jacket through the glass fiber jacket and the holes in the capsule. A portion of the aerosol forming material also will enter the jacket through the holes.

The foregoing preferred embodiment may be modified to incorporate one or more of the following changes: (a) the capsule may be a tube having a crimped mouth end only, with or without peripheral passages, or the shape of the mouthend portion of the capsule may be crimped into a rectangular, square, or other shape; (b) levulinic acid, at about 0.7 weight percent, may be added to the substrate; (c) the flavor materials may be added to the tobacco jacket instead of, or in addition to, the substrate; and (d) the container need not contain Marumerized tobacco.

What is claimed is:

1. A method of making an aerosol generating cartridge for a smoking article comprising filling a noncombustible elongated capsule, open at one end and having a wall at the other end, with a substrate bearing an aerosol forming material, and applying a fuel element to the open end of the capsule to enclose the substrate and the aerosol forming material within the capsule.

2. A method according to claim 1, comprising forming in the elongated capsule one or more perforations of smaller size than the substrate.

3. A method according to claim 1, comprising forming the capsule of a thin-walled metal tube and applying the fuel element to the capsule by inserting an end of the fuel element into the open end of the tube to a depth.

4. A method according to claim 1, further comprising the step of incorporating the fuel element within a sleeve of insulating material after the fuel element has been applied to the open end of the capsule.

5. A method according to claim 4, wherein the fuel element is applied to the open end of the capsule by inserting an end of the fuel element into the open end of the capsule.

6. A method according to claim 5, further comprising incorporating the capsule in a roll of tobacco.

7. A method according to claim 5, wherein the perforations are in the wall.

8. A method according to claim 4, further comprising incorporating the capsule in a roll of tobacco.

9. A method according to claim 1, comprising incorporating the portion of the aerosol generating cartridge comprising the capsule within a sleeve of tobacco and the portion comprising the fuel element within a sleeve of insulating material.

10. A method accoarding to claim 1, wherein the capsule is a heat conductive capsule.

11. A method according to claim 1, wherein the fuel element is carbonaceous.

12. A method according to claim 1, further comprising incorporating the capsule in a roll of tobacco.

13. A method according to claim 12, wherein the fuel element is applied to the open end of the capsule by inserting an end of the fuel element into the open end of the capsule.

* * * * *

UNITED STATES PATENT AND TRADEMARK OFFICE

CERTIFICATE OF CORRECTION

PATENT NO. : 5,042,509

DATED : August 27, 1991

INVENTOR(S) : Banerjee et al

It is certified that error appears in the above-identified patent and that said Letters Patent is hereby corrected as shown below:

Col. 3, line 32, "smoke" should be --smoking--.

Col. 5, line 60, "become" should be --because--.

Col. 6, line 19, after "or", insert --by--.

Col. 7, line 57, "at" (first occurrence) should be --of--.

Col. 9, line 26, "2" should be --42--.

Col. 17, line 44, "ot" should be --to--.

Col. 19, line 4, "Hoowever" should be --However--.

Col. 19, line 19, "maximized" should be --maximize--.

Col. 19, line 34, "ocnditions" should be --conditions--.

Col. 20, line 38, "form" should be --from--.

UNITED STATES PATENT AND TRADEMARK OFFICE

CERTIFICATE OF CORRECTION

PATENT NO. : 5,042,509

DATED : August 27, 1991

INVENTOR(S) : Banerjee et al

It is certified that error appears in the above-identified patent and that said Letters Patent is hereby corrected as shown below:

Col. 20, line 62, "KOP" should be --KCP--.

Signed and Sealed this

Second Day of March, 1993

*Attest:*

STEPHEN G. KUNIN

*Attesting Officer*

*Acting Commissioner of Patents and Trademarks*